US011386880B2

(12) United States Patent
Tobise et al.

(10) Patent No.: US 11,386,880 B2
(45) Date of Patent: Jul. 12, 2022

(54) ACOUSTIC OUTPUT APPARATUS

(71) Applicant: SONY CORPORATION, Tokyo (JP)

(72) Inventors: Hayami Tobise, Kanagawa (JP); Kenichi Oide, Tokyo (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 16/637,394

(22) PCT Filed: Jul. 17, 2018

(86) PCT No.: PCT/JP2018/026734
§ 371 (c)(1),
(2) Date: Feb. 7, 2020

(87) PCT Pub. No.: WO2019/035304
PCT Pub. Date: Feb. 21, 2019

(65) Prior Publication Data

US 2020/0251086 A1 Aug. 6, 2020

(30) Foreign Application Priority Data

Aug. 17, 2017 (JP) ..... JP2017-157640

(51) Int. Cl.
*G10K 11/178* (2006.01)
*H04R 1/10* (2006.01)

(52) U.S. Cl.
CPC ..... *G10K 11/17827* (2018.01); *H04R 1/1075* (2013.01); *H04R 1/1083* (2013.01); *G10K 2210/1081* (2013.01); *H04R 2460/01* (2013.01)

(58) Field of Classification Search
CPC .... H04R 1/1083; H04R 1/1075; H04R 5/033; H04R 2460/01; H04R 1/1008;
(Continued)

(56) References Cited

U.S. PATENT DOCUMENTS 5,692,059 A 11/1997 Kruger
7,466,838 B1 * 12/2008 Moseley ..... G10K 11/178 381/370
(Continued)

FOREIGN PATENT DOCUMENTS

CN 103039090 A 4/2013
CN 104956685 A 9/2015
(Continued)

OTHER PUBLICATIONS

International Search Report and Written Opinion of PCT Application No. PCT/JP2018/026734, dated Oct. 9, 2018, 08 pages of ISRWO.
(Continued)

*Primary Examiner* — Norman Yu
(74) *Attorney, Agent, or Firm* — Chip Law Group

(57) ABSTRACT

The problem to be solved is to improve a noise cancelling function. A detection microphone, a speaker, and a housing are included. The detection microphone detects noise and has an input vibrating plate. The speaker has an output vibrating plate. The housing accommodates at least the speaker and the detection microphone therein. The input vibrating plate and the output vibrating plate are disposed approximately in the same orientation. This ensures that a sound is output from the speaker while a sound is input to the detection microphone with the input vibrating plate and the output vibrating plate facing each other, thus making it possible to bring the input vibrating plate and the output vibrating plate closer to each other. As a result, it is less likely for a phase lag to take place between the sound output from the speaker and the sound input to the detection microphone, thus providing higher noise detection accuracy of the detection microphone and contributing to an improved noise cancelling function.

11 Claims, 7 Drawing Sheets

(58) Field of Classification Search

CPC ..... H04R 2201/003; H04R 2225/41; H04R 2410/05; H04R 1/04; H04R 2201/107; H04R 2225/025; H04R 2410/01; H04R 25/00; G10K 2210/1081; G10K 11/17823; G10K 11/17827; G10K 2210/108

USPC ..... 381/71.6, 74, 71.1, 94.1, 312, 56, 370, 381/317, 309, 328, 122, 375, 23.1, 91, 1, 381/26, 150, 357, 367, 13; 704/226, 704/575.2, 570

See application file for complete search history.

(56) References Cited

U.S. PATENT DOCUMENTS

| | | | | |
|---|---|---|---|---|
| 2010/0166204 | A1 | 7/2010 | Yanagishita et al. | |
| 2011/0280411 | A1* | 11/2011 | Cheah | G10K 11/17823 381/71.6 |
| 2012/0087532 | A1 | 4/2012 | Yang | |
| 2013/0315415 | A1* | 11/2013 | Shin | H04R 1/08 381/74 |
| 2014/0072134 | A1* | 3/2014 | Po | G10K 11/178 381/71.11 |
| 2014/0205131 | A1* | 7/2014 | Azmi | H04R 1/1075 381/380 |
| 2016/0302000 | A1* | 10/2016 | Shin | H04R 1/1016 |
| 2016/0372104 | A1 | 12/2016 | Nystrom | |

FOREIGN PATENT DOCUMENTS

| | | | |
|---|---|---|---|
| CN | 105120387 | A | 12/2015 |
| CN | 106060689 | A | 10/2016 |
| CN | 107787589 | A | 3/2018 |
| CN | 109511028 | A | 3/2019 |
| DE | 102011015569 | A1 | 4/2012 |
| EP | 3311588 | A1 | 4/2018 |
| JP | 05-333873 | A | 12/1993 |
| JP | 2009-284097 | A | 12/2009 |
| JP | 2010-157787 | A | 7/2010 |
| JP | 2012-085257 | A | 4/2012 |
| JP | 2013-526798 | A | 6/2013 |
| JP | 2017-034702 | A | 2/2017 |
| KR | 10-2012-0035836 | A | 4/2012 |
| KR | 10-2015-0108907 | A | 9/2015 |
| KR | 10-2016-0121172 | A | 10/2016 |
| TW | 201433174 | A | 8/2014 |
| WO | 2007/086360 | A1 | 8/2007 |
| WO | 2011/142722 | A1 | 11/2011 |
| WO | 2012/042672 | A1 | 4/2012 |
| WO | 2014/116388 | A1 | 7/2014 |
| WO | 2016/206764 | A1 | 12/2016 |

OTHER PUBLICATIONS

Extended European Search Report of EP Application No. 18847131.2, dated Jul. 23, 2020, 09 pages.

Office Action for CN Patent Application No. 201880051340.3, dated Jun. 3, 2021, 9 pages of Office Action and 5 pages of English Translation.

Office Action for JP Patent Application No. 2019-536446, dated Apr. 26, 2022, 5 pages of Office Action and 4 pages of English Translation.

* cited by examiner

ACOUSTIC OUTPUT APPARATUS

CROSS REFERENCE TO RELATED APPLICATIONS

This application is a U.S. National Phase of International Patent Application No. PCT/JP2018/026734 filed on Jul. 17, 2018, which claims priority benefit of Japanese Patent Application No. JP 2017-157640 filed in the Japan Patent Office on Aug. 17, 2017. Each of the above-referenced applications is hereby incorporated herein by reference in its entirety.

TECHNICAL FIELD

The present technology relates to an acoustic output apparatus having a detection microphone for detecting noise.

BACKGROUND ART

An acoustic output apparatus is available that is worn on a head or an ear for use as a headphone or an earphone to output a sound from a speaker.

Such an acoustic output apparatus should preferably be maintained in a high-quality output state, and it is particularly desirable that a sound output from the speaker with minimal noise should reach eardrums.

For such an acoustic output apparatus described above, a noise cancelling type has been developed that provides reduced noise (refer, for example, to PTL 1).

Such a noise cancelling type of acoustic output apparatus receives an external sound through a detection microphone for noise detection and outputs a noise cancelling signal that allows a user to perceive a sensation that noise detected by the detection microphone for noise detection is minimal.

The user perceives a sensation that the noise has been cancelled as a result of output of the noise cancelling signal, thus ensuring that the user hears a high-quality sound with minimal noise.

CITATION LIST

[Patent Literature]
[PTL 1]
Japanese Patent Laid-Open No. 2017-34702

SUMMARY

Technical Problem

Incidentally, an acoustic output apparatus such as a headphone or an earphone is used not only in a stationary stereo set or the like but also in a mobile phone, a compact music reproduction apparatus, and so on, and widespread use of mobile phones and other apparatuses in recent years has witnessed an increasing number of aspects in which acoustic output apparatuses are used outdoors in addition to aspects in which acoustic output apparatuses are used indoors. Therefore, it is particularly desirable that a high-quality output state with reduced external noise should be maintained in accordance with outdoor usage conditions.

In light of the foregoing, it is an object of the acoustic output apparatus of the present technology to overcome the above problem and provide an improved noise cancelling function.

Solution to Problem

Firstly, an acoustic output apparatus according to the present technology includes a detection microphone for detecting noise having an input vibrating plate, a speaker having an output vibrating plate, and a housing accommodating at least the speaker and the detection microphone therein. The input vibrating plate and the output vibrating plate are disposed approximately in a same orientation.

This ensures that a sound is output from the speaker while a sound is input to the detection microphone with the input vibrating plate and the output vibrating plate facing each other, thus making it possible to bring the input vibrating plate and the output vibrating plate closer to each other. As a result, it is less likely for a phase lag to take place between the sound output from the speaker and the sound input to the detection microphone.

Secondly, it is desirable that at least part of the detection microphone should be located to be opposed to the speaker in the above acoustic output apparatus.

As a result, part of the detection microphone faces the speaker.

Thirdly, it is desirable that the detection microphone as a whole should be located to be opposed to the speaker in the above acoustic output apparatus.

As a result, the detection microphone as a whole faces the speaker.

Fourthly, it is desirable that a distance between the detection microphone and the speaker should be equal to or less than a radius of the detection microphone in the above acoustic output apparatus.

This makes it unlikely, since the distance between the detection microphone and the speaker is small, for a phase lag to take place between the sound output from the speaker and the sound input to the detection microphone.

Fifthly, it is desirable that a sound output device should be provided to output a sound that differs in frequency band from a sound output from the speaker in the above acoustic output apparatus.

This makes it possible, even in the case where the speaker may diminish in its capability to output sounds in a specific band, for the user to hear excellent sounds in a broad band by a sound in the specific band output from the sound output device.

Sixthly, it is desirable that an opening should be formed in the housing and that a sensing microphone should be provided to detect noise input from the opening in the above acoustic output apparatus.

This ensures that noise is detected not only by the detection microphone but also by the sensing microphone, thus enhancing a noise reduction characteristic.

Seventhly, it is desirable that the sensing microphone should be provided inside the housing and that the detection microphone should be located on an opposite side of the sensing microphone with the speaker provided therebetween in the above acoustic output apparatus.

This ensures that the detection microphone and the sensing microphone are located on the opposite sides to each other with the speaker provided therebetween inside the housing.

Eighthly, it is desirable that a bracket should be provided that has a sound conduit through which the sound output from the speaker passes and that the speaker and the detection microphone should be attached to the bracket in the above acoustic output apparatus.

This eliminates the need for dedicated members for attaching the speaker and the detection microphone, respectively, because the speaker and the detection microphone are attached to the same member.

Ninthly, it is desirable that a sound output device should be provided to output a sound that differs in frequency band from the sound output from the speaker and that the sound output device should be attached to the bracket in the above acoustic output apparatus.

This ensures that the speaker, the detection microphone, and the sound output device are all attached to the same member, thus eliminating the need for dedicated members for attaching the speaker, the detection microphone, and the sound output device, respectively.

Tenthly, it is desirable that the sound output from the sound output device should pass through the sound conduit in the above acoustic output apparatus.

This ensures that the sound output from the speaker and the sound output from the sound output device are both output externally through the sound conduit, thus eliminating the need for separate sound conduits through which the sound output from the speaker and the sound output from the sound output device pass, respectively.

Eleventhly, another sound output apparatus according to the present technology includes a detection microphone for detecting noise having an input vibrating plate, a speaker having an output vibrating plate, and a housing accommodating at least the speaker and the detection microphone therein. The speaker has its axis extending approximately in a same direction as an axis of the detection microphone.

This ensures that a sound is output from the speaker while a sound is input to the detection microphone with the speaker having its axis extending approximately in the same direction as the axis of the detection microphone, thus making it possible to bring the speaker and the detection microphone closer to each other. As a result, it is less likely for a phase lag to take place between the sound output from the speaker and the sound input to the detection microphone.

Advantageous Effect of Invention

According to the present technology, a sound is output from a speaker while a sound is input to a detection microphone with an input vibrating plate and an output vibrating plate facing each other, thus making it possible to bring the input vibrating plate and the output vibrating plate closer to each other. As a result, it is less likely for a phase lag to take place between the sound output from the speaker and the sound input to the detection microphone. This provides higher noise detection accuracy of the detection microphone, thus contributing to an improved noise cancelling function.

It should be noted that the effect recited in the present specification are merely illustrative and not restrictive, and there may be other effects.

BRIEF DESCRIPTION OF DRAWINGS

FIG. 1 is a perspective view of the acoustic output apparatus.

DESCRIPTION OF EMBODIMENT

A description will be given below of a mode for carrying out an acoustic output apparatus of the present technology with reference to attached drawings.

In an embodiment described below, the acoustic output apparatus of the present technology is applied to an earphone. It should be noted, however, that the range of application of the present technology is not limited to an earphone and the present technology is widely applicable to a variety of other acoustic output apparatuses such as a headphone.

It should be noted that the acoustic output apparatus illustrated below has not only a speaker and a sound output device as sound output sections but also a sound conduit through which sounds output respectively from the speaker and the sound output device pass. In the description given below, longitudinal, horizontal, and vertical directions are represented by assuming that the sound conduit has its axial direction extending longitudinally and that the speaker and the sound output device are disposed vertically side by side.

It should be noted, however, that the longitudinal, horizontal, and vertical directions illustrated below are provided for convenience of explanation and that the directions are not limited thereto in carrying out the present technology.

<Configuration of The Acoustic Output Apparatus>

A description will be given below of a configuration of an acoustic output apparatus 1 (refer to FIGS. 1 to 6). The acoustic output apparatuses 1 are used, for example, in pairs, and one of the pairs is used for the left ear, and the other is used for the right ear. It should be noted, however, that only the one acoustic output apparatus 1 may be used to hear sounds.

Figure 1:
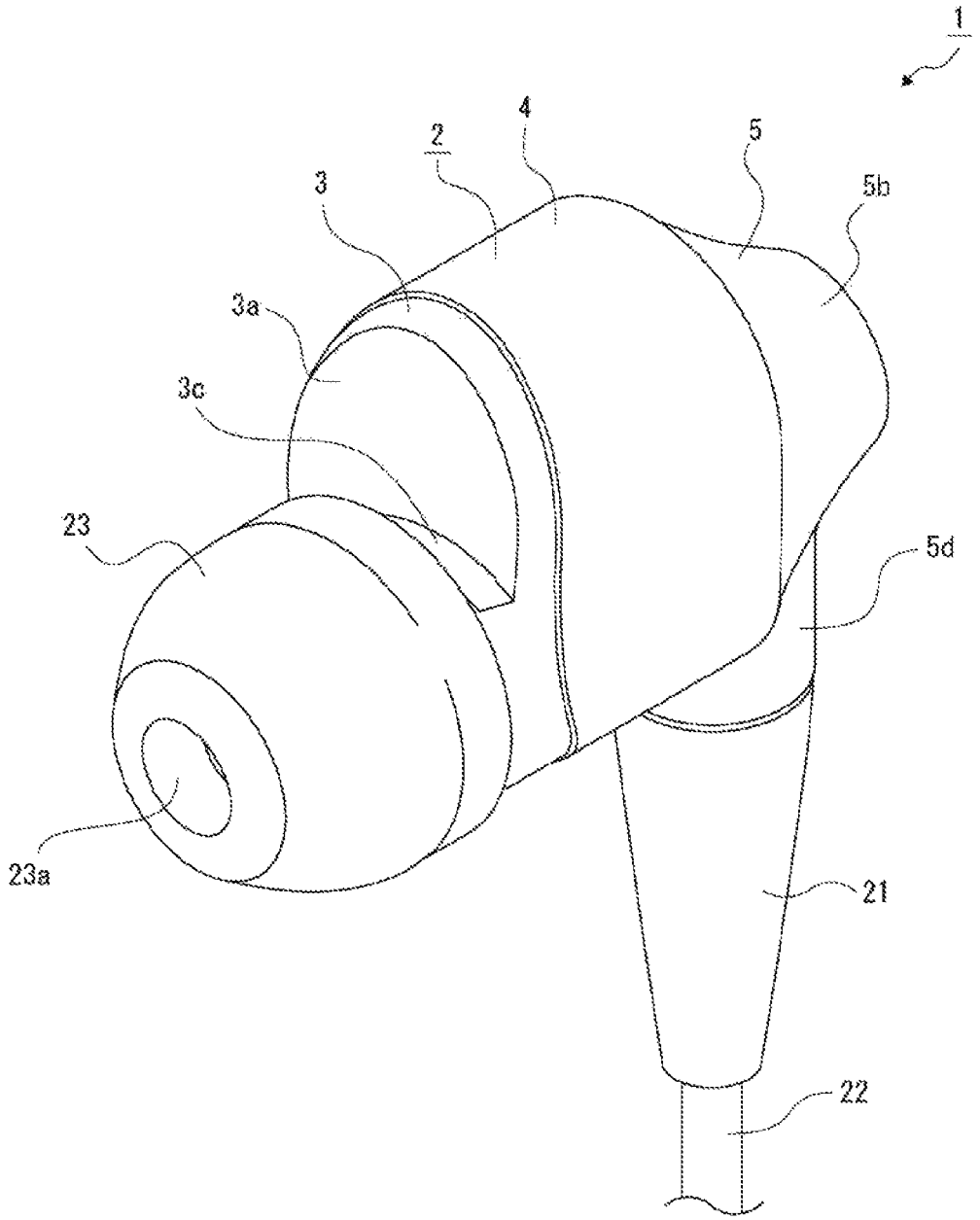
FIG. 1 illustrates, together with FIGS. 2 to 8, an embodiment of an acoustic output apparatus of the present technology.
Figure 2:
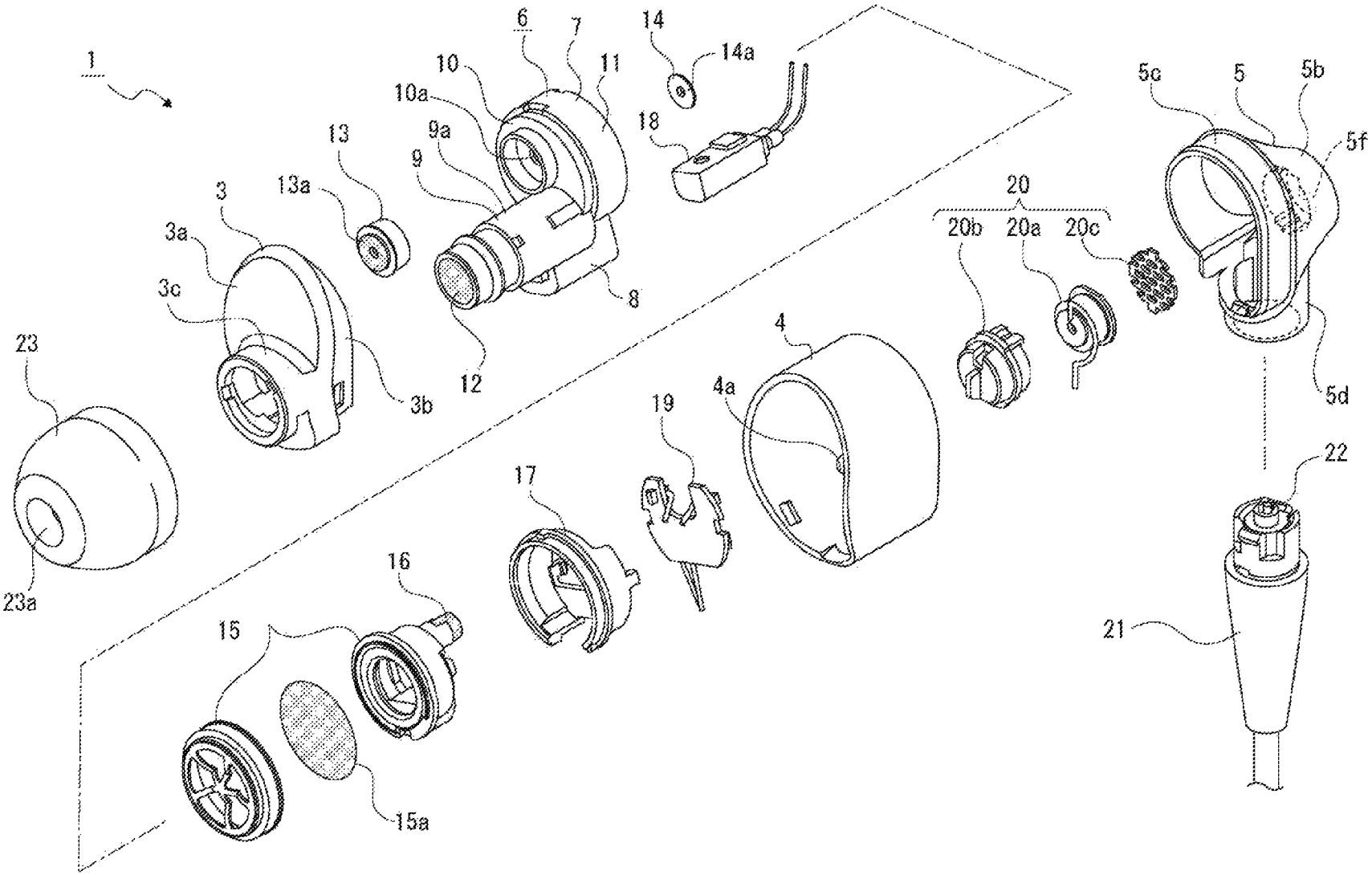
FIG. 2 is an exploded perspective view of the acoustic output apparatus.
Figure 3:
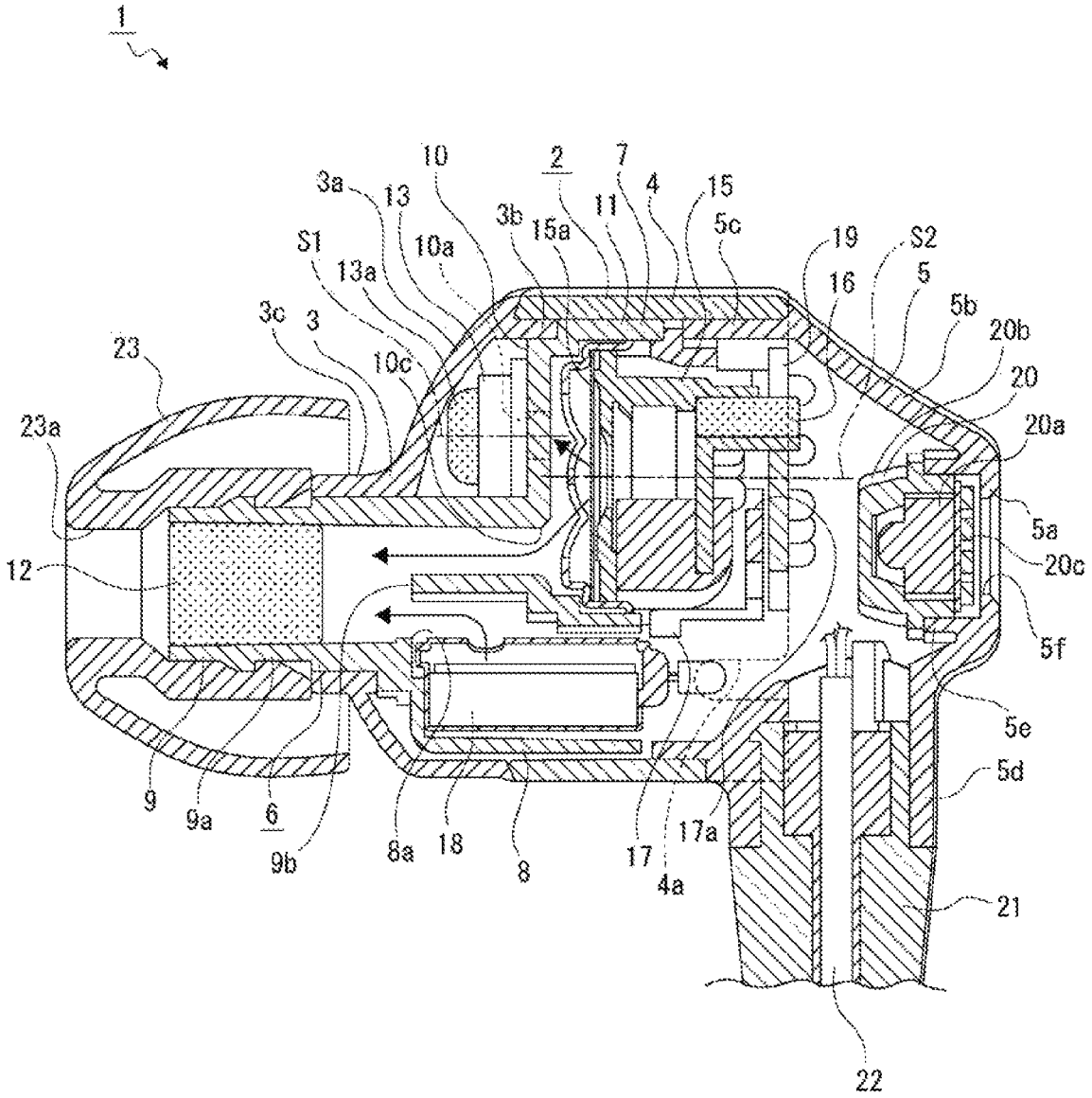
FIG. 3 is an enlarged sectional view of the acoustic output apparatus.
Figure 4:
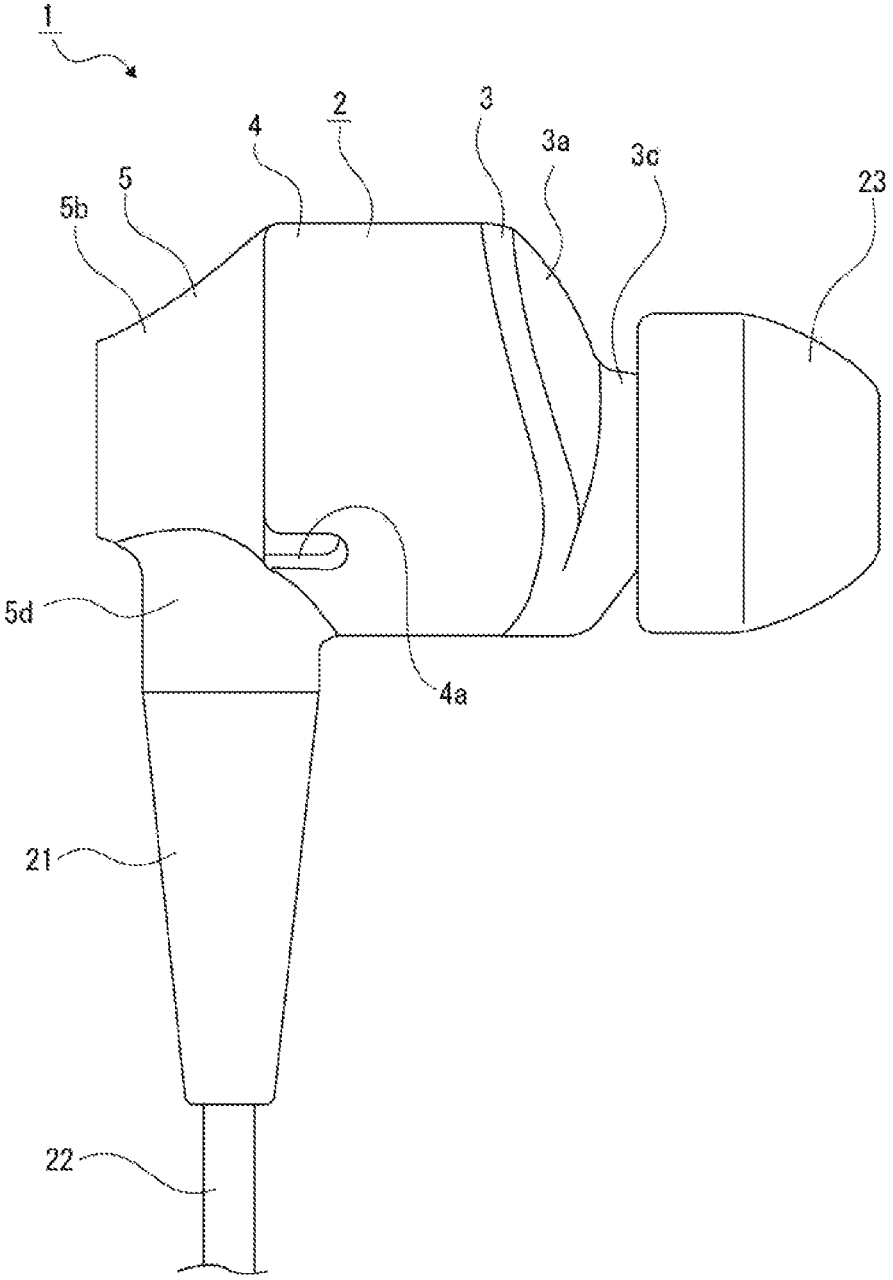
FIG. 4 is an enlarged side view of the acoustic output apparatus.

The acoustic output apparatus 1 includes various necessary sections inside and outside a housing 2, and the housing 2 includes a front cover 3, a middle cover 4, and a rear cover 5 that are joined together from the front in sequence (refer to FIGS. 1 to 3).

The front cover 3 has a cover surface section 3*a*, a joint surface section 3*b*, and a holding tube section 3*c*. The cover surface section 3*a* is open rearward and approximately in the shape of a bowl. The joint surface section 3*b* protrudes rearward from a portion of the cover surface section 3*a* close to its periphery. The holding tube section 3*c* protrudes forward from the cover surface section 3*a*. The joint surface section 3*b* is formed approximately in the shape of an arc surface and protrudes rearward from the portion of the cover surface section 3*a* close to its periphery with the exception of a lower end portion.

The middle cover 4 is formed in the shape of a tube having its axial direction extending longitudinally and has approximately the same outer size and shape as the cover section 3*a*. The middle cover 4 has a vent hole 4*a* at its lower end portion (refer to FIG. 4).

The rear cover 5 has a rear surface section 5*a*, a circumferential surface section 5*b*, a joint surface section 5*c*, an insertion tube section 5*d*, and an attachment tube section 5*e* (refer to FIGS. 1 to 3).

The rear surface section 5*a* is formed in an annular shape having its axial direction extending longitudinally. An inner space of the rear surface section 5*a* is formed as an opening 5*f*. The circumferential surface section 5*b* protrudes forward from a peripheral portion of the rear surface section 5*a* and is formed in such a shape that an outer shape thereof increases toward the front. The joint surface section 5*c* protrudes forward from a front end portion of the circumferential surface section 5*b* with the exception of the lower end portion. The insertion tube section 5*d* is formed in a cylindrical shape that protrudes downward from the lower end portion of the circumferential surface section 5*b*. The attachment tube section 5*e* is formed in a cylindrical shape that protrudes forward from the rear surface section 5*a*.

The housing 2 is formed by joining a front end portion of the middle cover 4 with the joint surface section 3*b* of the front cover 3 such that the front end portion of the middle cover 4 is fitted onto the joint surface section 3*b* and by joining a rear end portion of the middle cover 4 with the joint surface section 5*c* of the rear cover 5 such that the rear end portion of the middle cover 4 is fitted onto the joint surface section 5*c*.

The housing 2 has a bracket 6, and part of the bracket 6 protrudes forward from the holding tube section 3*c*. The bracket 6 has a first attachment section 7, a second attachment section 8, and a sound conduit 9.

The first attachment section 7 has a base surface section 10 and a tube surface section 11. The base surface section 10 is disposed in a longitudinal orientation and approximately in the shape of a disk. The tube surface section 11 protrudes rearward from a peripheral portion of the base surface section 10. A sound input hole 10*a*, an adjustment hole 10*b*, and a first sound passage hole 10*c* are formed in this order from top in the base surface section 10 (refer to FIG. 5).

Figure 5:
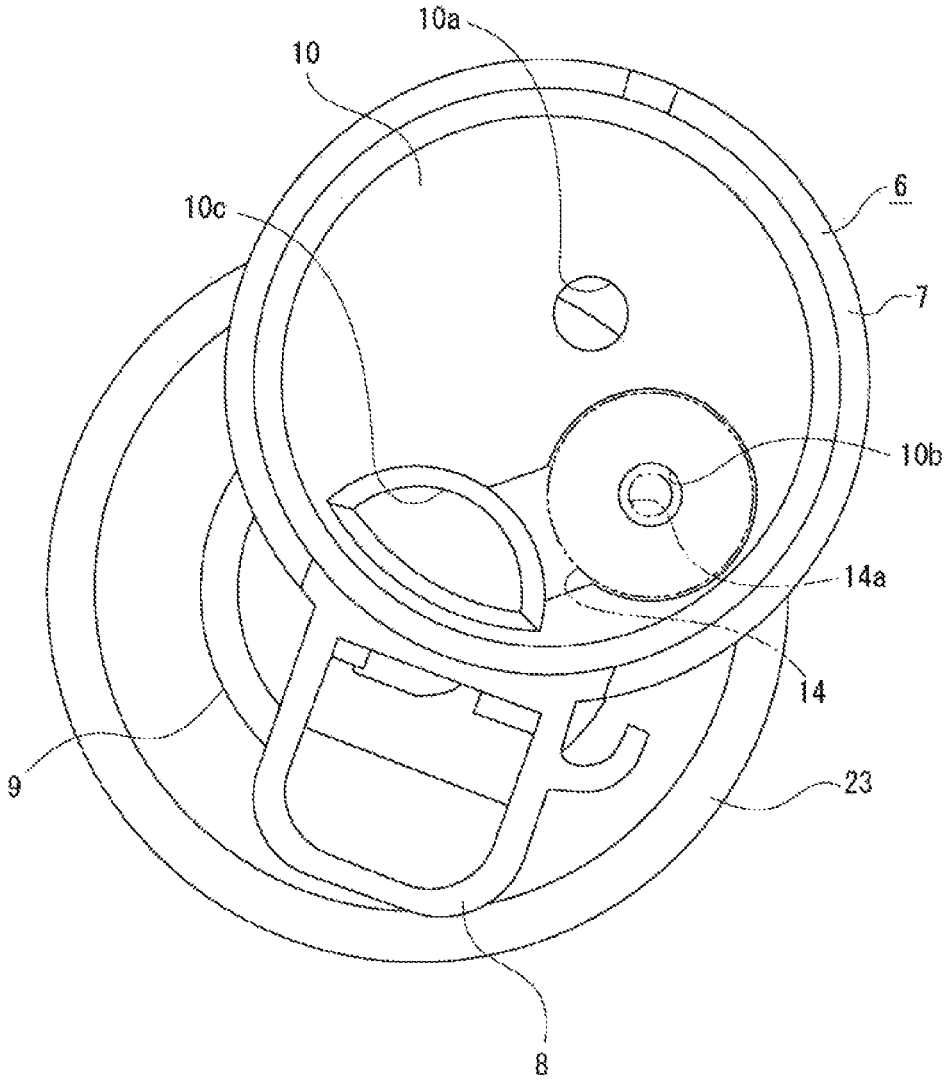
FIG. 5 is an enlarged rear view illustrating a bracket and a cap.
Figure 6:
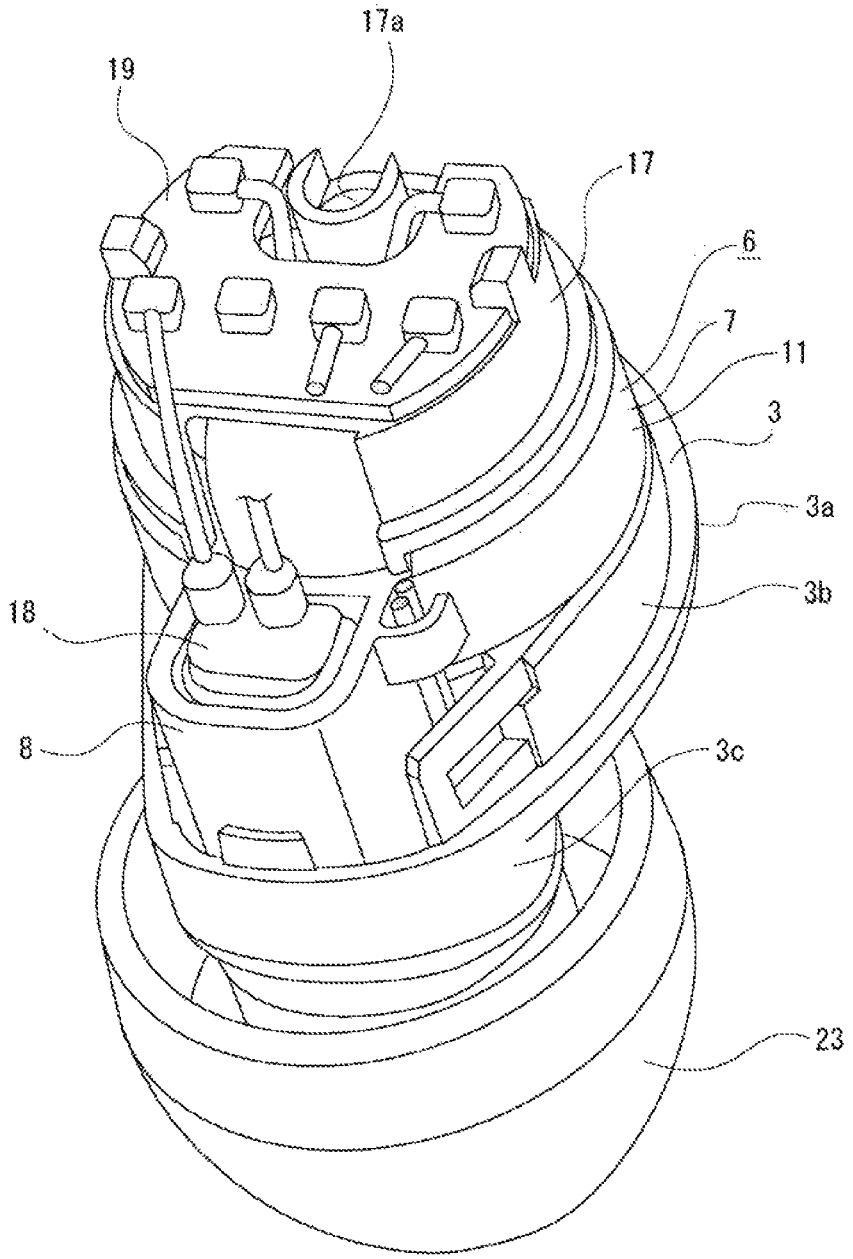
FIG. 6 is an enlarged perspective view illustrating part of an internal structure, etc.

Formed in the shape of a case that extends longitudinally and is open rearward, the second attachment section 8 is located under the first attachment section 7, and an approximately rear half portion of the second attachment section 8 vertically is continuous with the first attachment section 7 (refer to FIGS. 2, 3, and 5). A second sound passage hole 8*a* that penetrates a front half portion of the second attachment section 8 is formed in an upper surface section of the second attachment section 8.

The sound conduit 9 has a sound tube section 9*a* and a partitioning plate 9*b*. The sound tube section 9*a* has its axial direction extending longitudinally and is approximately in a cylindrical shape. The partitioning plate 9*b* is located inside the sound tube section 9*a*. The sound conduit 9 protrudes forward from a lower end portion of the base surface section 10, and an approximately rear half portion of the sound conduit 9 is continuous with an approximately front half portion of the second attachment section 8. A first sound passage hole 10*c* of the base surface section 10 communicates with the second sound passage hole 8*a* of the second attachment section 8 in an inner space of the sound tube section 9*a*. The partitioning plate 9*b* is disposed in a vertical orientation and protrudes forward from a lower opening edge of the first sound passage hole 10*c* formed in the base surface section 10, and left and right side edges thereof are continuous with an inner surface of the sound tube section 9*a*, respectively. Therefore, part of the inner space of the sound conduit 9 is partitioned vertically by the partitioning plate 9*b*.

The portion of the bracket 6 other than a front end portion of the sound conduit 9 is provided inside the housing 2, and the sound tube section 9*a* is held in a manner inserted in the holding tube section 3*c* of the front cover 3. A front end portion of the sound tube section 9*a* of the bracket 6 protrudes forward from the holding tube section 3*c*.

An equalizer 12 is provided in a manner press-fitted into the front end portion of the sound tube section 9*a*. The equalizer 12 includes, for example, compressed urethane and primarily has a function to adjust, of the sounds that pass through the sound tube section 9*a*, the extent to which high frequencies are attenuated.

A detection microphone 13, a register 14, and a speaker 15 are attached to the first attachment section 7 of the bracket 6.

The detection microphone 13 functions as a feedback microphone for detecting noise near an ear and is attached at a position where the detection microphone 13 covers the sound input hole 10*a* on the front surface of the base surface section 10. The detection microphone 13 has an input vibrating plate 13*a* that is formed circular in outer shape and disposed approximately in a longitudinal orientation.

The register 14 is formed, for example, in an annular shape and attached to a rear surface of the base surface section 10 with a center hole 14*a* located immediately behind the adjustment hole 10*b*. The register 14 primarily has a function to adjust, of the sounds output from the speaker 15, the sensitivity to low-frequency sounds. The center hole 14*a* of the register 14 is smaller in diameter than the adjustment hole 10*b* of the base surface section 10.

The speaker 15 is attached to the bracket 6 with a front portion of the speaker 15 inserted in the first attachment section 7. The speaker 15 has an output vibrating plate 15*a* that is formed circular in outer shape and orientated approximately longitudinally.

As described above, the detection microphone 13 is attached to the front surface of the base surface section 10, the speaker 15 is attached to the rear surface of the base surface section 10, and the detection microphone 13 is located right in front of the speaker 15. Therefore, the detection microphone 13 as a whole is located to be opposed to the speaker 15. The input vibrating plate 13*a* of the detection microphone 13 and the output vibrating plate 15*a* of the speaker 15 are both oriented approximately longitudinally and disposed approximately in the same orientation. The speaker 15 can output sounds in a wide range of low to high frequencies.

With the detection microphone 13 and the speaker 15 attached to the bracket 6, a distance between the detection microphone 13 and the speaker 15 is equal to or less than a radius of the detection microphone 13. Specifically, for example, the radius of the detection microphone 13 is 2 mm, and the distance between the detection microphone 13 and the speaker 15 is equal to or less than 1 mm.

Also, the detection microphone 13 (direction of a central axis S1) and the speaker 15 (direction of a central axis S2) both have their axes extending longitudinally, and the detection microphone 13 and the speaker 15 have their axes extending approximately in the same direction.

A sound absorbing material 16 is attached to a rear surface of the speaker 15. The sound absorbing material 16 includes, for example, compressed urethane and primarily has a function to adjust, of the sounds output from the speaker 15, the sensitivity to medium and low frequencies.

With the speaker 15 attached to the bracket 6, part of the speaker 15 protrudes rearward from the first attachment section 7, and this protruding portion is covered by a speaker cover 17. A disposition hole 17*a* is formed in the speaker cover 17. The speaker cover 17 is attached, from the rear, to the first attachment section 7 of the bracket 6 in such a manner as to cover the speaker 15 from the rear. With the speaker 15 covered by the speaker cover 17, the sound absorbing material 16 is disposed in the disposition hole 17*a*.

A sound output device 18 is attached to the second attachment section 8 of the bracket 6. A microphone unit 20 is located in a region posterior to the speaker 15. The sound output device 18 is disposed in a manner inserted in the second attachment section 18 from the rear. The sound output device 18 functions, for example, as a tweeter and outputs high-frequency sounds that differ in frequency band from the sounds output from the speaker 15.

A circuit board 19 is attached to a rear surface of the speaker cover 17. The circuit board 19 drives and controls the speaker 15 and the sound output device 18.

The microphone unit 20 is attached to the attachment tube section 5*e* of the rear cover 5. The microphone unit 20 has a sensing microphone 20*a*, a microphone casing 20*b*, and a microphone sheet 20*c*. The sensing microphone 20*a* is covered by the microphone casing 20*b* from the front, and the microphone sheet 20*c* is attached to a rear surface of the sensing microphone 20*a*. The sensing microphone 20*b* is attached to the attachment tube section 5*e* inside the housing 2 to function as a feedforward microphone for detecting noise input from the opening 5*f* at a peripheral side position of the acoustic output apparatus 1.

A bushing 21 is inserted into and attached to the insertion tube section 5*d* of the rear cover 5. A cable 22 is sheathed inside the bushing 21, and the cable 22 is connected to the circuit board 19, the detection microphone 13, and the sensing microphone 20*a*.

A cap 23 is attached to the portion of the sound conduit 9 that protrudes forward from the holding tube section 3*c* of the front cover 3. The cap 23 includes a rubber material, etc. and is inserted into an ear hole when a user uses the acoustic output apparatus 1. A passage hole 23*a* that communicates with the inner space of the sound conduit 9 is formed in the cap 23.

As described above, in the acoustic output apparatus 1, the sensing microphone 20*a* is disposed in the housing 2, and the detection microphone 13 and the sensing microphone 20*a* are located on the opposite sides to each other with the speaker 15 provided therebetween.

Therefore, because the detection microphone 13 and the sensing microphone 20*a* are located on the opposite sides to each other with the speaker 15 provided therebetween inside the housing 2, the acoustic output apparatus 1 can be downsized through effective use of the space.

Also, the bracket 6 is provided that has the sound conduit 9 to permit passage of sounds output from the speaker 15, and the speaker 15 and the detection microphone 13 are attached to the bracket 6.

Therefore, the speaker 15 and the detection microphone 13 are attached to the same member, thus eliminating the need for dedicated members for attaching the speaker 15 and the detection microphone 13, respectively, and ensuring further downsizing of the acoustic output apparatus 1 through reduced parts count.

Further, the sound output device 18 is attached to the bracket 6. As a result, the speaker 15, the detection microphone 13, and the sound output device 18 can all be attached to the same member, thus eliminating the need for dedicated members for attaching the speaker 15, the detection microphone 13, and the sound output device 18, respectively, and ensuring further downsizing of the acoustic output apparatus 1 through reduced parts count.

<Operation of The Acoustic Output Apparatus>

In the acoustic output apparatus 1 configured as described above, when a sound is output from the speaker 15, the output sound passes through the sound conduit 9 from the first sound passage hole 10*c* of the base surface section 10. At this time, the sound passes above the partitioning plate 9*a* in the sound conduit 9 and reaches the user's eardrum via the passage hole 23*a* of the cap 23.

At the same time, a sound is also output from the sound output device 18, and the output sound passes through the sound conduit 9 from the second sound passage hole 8*a* of the second attachment section 8. At this time, the sound passes below the partitioning plate 9*a* in the sound conduit 9 and reaches the user's eardrum via the passage hole 23*a* of the cap 23.

The sounds that are output from the speaker 15 and the sound output device 18 and pass through the sound conduit 9 are adjusted by the equalizer 12 in terms of the extent to which high frequencies are attenuated, thus allowing a sound whose high frequencies have properly been adjusted reaches the eardrum.

As described above, the sound output from the sound output device 18 passes through the sound conduit 9.

Therefore, the sounds that are output from the speaker 15 and the sound output device 18 are both externally output through the sound conduit 9, thus eliminating the need for separate sound conduits through which the sound output from the speaker 15 and the sound output from the sound output device 18 pass, respectively, ensuring downsizing of the acoustic output apparatus 1 through reduced parts count, and contributing to reduced manufacturing cost.

When a sound is output from the speaker 15, the output sound not only passes through the sound conduit 9 but also is input to the detection microphone 13 from the sound input hole 10*a* of the base surface section 10.

Also, at the same time, the sound output from the speaker 15 passes through the center hole 14*a* of the register 14 via the adjustment hole 10*b* of the base surface section 10. At the same time, the sensitivity to low frequencies is adjusted by the register 14. The sound that has passed through the center hole 14*a* of the register 14 is guided downward through the inner side of the front cover 3 and released externally from the vent hole 4*a* of the middle cover 4.

Further, when a sound is output from the speaker 15, the sound is also output rearward, and the sensitivity to medium and low frequencies is adjusted by the sound absorbing material 16. At least part of the sound output rearward from the speaker 15 is guided downward and released externally from the vent hole 4*a* of the middle cover 4.

When sounds are output from the speaker 15 and the sound output device 18 at the same time, a noise cancelling function is activated by the detection microphone 13 and the sensing microphone 20*a*. The noise cancelling function primarily detects noise in the sound passing through the sound conduit 9 with the detection microphone 13, detects noise in external sounds with the sensing microphone 20*a*, and then generates, with a noise cancelling circuit which is not illustrated, a noise cancelling signal that causes the user to perceive that each detected noise is minimal.

Since the noise cancelling signal is generated, the user perceives that the noise detected by the detection microphone 13 and the sensing microphone 20*a*, respectively, have been cancelled, thus hearing high-quality sounds with minimal noise.

<Conclusion>

As described above, the acoustic output apparatus 1 has the detection microphone 13, the speaker 15, and the housing 2. The detection microphone 13 has the input vibrating plate 13*a* for detecting noise. The speaker 15 has the output vibrating plate 15*a*. The housing 2 accommodates at least the speaker 15 and the detection microphone 13 therein. The input vibrating plate 13*a* and the output vibrating plate 15*a* are disposed approximately in the same orientation.

Therefore, a sound is output from the speaker 15 while a sound is input to the detection microphone 13 with the input vibrating plate 13*a* and the output vibrating plate 15*a* facing each other, thus making it possible to bring the input vibrating plate and the output vibrating plate closer to each other. This makes it less likely for a phase lag to take place between the sound output from the speaker 15 and the sound input to the detection microphone 13, thus providing higher noise detection accuracy of the detection microphone 13 and improving a noise cancelling function.

Also, the detection microphone 13 and the speaker 15 have their axes extending approximately in the same direction.

Therefore, a sound is output from the speaker 15 while a sound is input to the detection microphone 13 with the speaker 15 and the detection microphone 13 having their axes extending approximately in the same direction, thus making it possible to bring the speaker 15 and the detection microphone 13 closer to each other. This makes it less likely for a phase lag to take place between the sound output from the speaker 15 and the sound input to the detection microphone 13, thus providing higher noise detection accuracy of the detection microphone 13 and contributing to an advanced noise cancelling function.

Further, the detection microphone 13 as a whole is located to be opposed to the speaker 15. As a result, the detection microphone 13 as a whole faces the speaker 15, thus contributing to an even more advanced noise cancelling function.

Further, the distance between the detection microphone 13 and the speaker 15 is equal to or less than the radius of the detection microphone 13. This makes it even more unlikely, since the distance between the detection microphone 13 and the speaker 15 is small, for a phase lag to take place between the sound output from the speaker 15 and the sound input to the detection microphone 13, thus contributing to an even more advanced noise cancelling function.

In addition, the sensing microphone 20*a* is provided to detect noise input from the opening 5*f* of the housing 2. Therefore, noise is detected not only by the detection microphone 13 but also by the sensing microphone 20*a*, thus providing a higher noise reduction characteristic and contributing to improved sound quality of the acoustic output apparatus 1.

In the acoustic output apparatus 1, the input vibrating plate 13*a* of the detection microphone 13 and the output vibrating plate 15*a* of the speaker 15 are disposed approximately in the same orientation as described above, thus providing higher noise detection accuracy of the detection microphone 13 and contributing to an improved noise cancelling function.

However, in the case where the noise cancelling function is improved by orienting the input vibrating plate 13*a* and the output vibrating plate 15*a* approximately in the same direction, the speaker 15 may diminish in output of sounds in a specific range such as high-frequency sounds.

For this reason, the sound output device 18 is provided in the acoustic output apparatus 1 to output a sound that differs in frequency band from the sound output from the speaker 15. The sound output device 18 outputs high-frequency sounds, for example, as described above. As a result, even in the case where the speaker 15 may diminish in its capability to output high-frequency sounds, the user can hear excellent sounds in a wide range of low to high frequencies by high-frequency sounds output from the sound output device 18.

As described above, the sound output device 18 is provided in the acoustic output apparatus 1 to output a sound that differs in frequency band from the sound output from the speaker 15. Therefore, even in the case where the speaker 15 diminishes in its capability to output sounds in some frequency bands, it is possible for the sound output device 18 to output the sounds which the speaker 15 has diminished in its capability to output, thus making it possible to output a wide range of sounds.

<Others>

Figure 7:
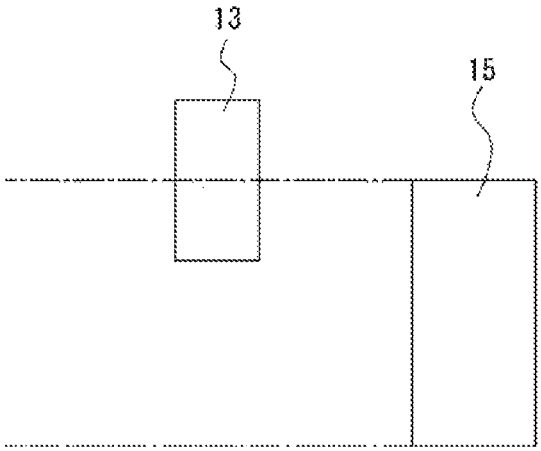
FIG. 7 is a side view illustrating an example in which part of a detection microphone is located to be opposed to a speaker.

Although an example is illustrated above in which the detection microphone 13 as a whole is located to be opposed to the speaker 15, part of the detection microphone 13 may be located to be opposed to the speaker 15 in the acoustic output apparatus 1 (refer to FIG. 7).

Even in the case where part of the detection microphone 13 is located to be opposed to the speaker 15 as described above, part of the detection microphone 13 faces the speaker 15, thus contributing to an excellent noise cancelling function.

Figure 8:
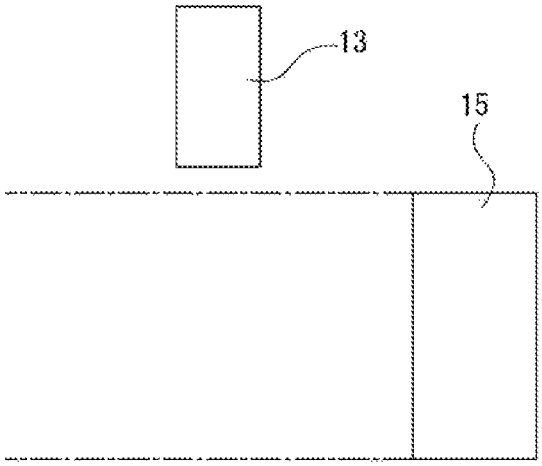
FIG. 8 is a side view illustrating an example in which the detection microphone is located not to be opposed to the speaker.

Also, as long as the input vibrating plate 13*a* of the detection microphone 13 and the output vibrating plate 15*a* of the speaker 15 are disposed approximately in the same orientation, the detection microphone 13 as a whole may not be located to be opposed to the speaker 15 at all (refer to FIG. 8).

Further, as long as the speaker 15 has its axis extending approximately in the same direction as the axis of the detection microphone 13, the detection microphone 13 as a whole may not be located to be opposed to the speaker 15 at all.

As described above, orienting the input vibrating plate 13*a* of the detection microphone 13 and the output vibrating plate 15*a* of the speaker 15 approximately in the same direction or disposing the speaker 15 and the detection microphone 13 such that their axes extend approximately in the same direction makes it unlikely for a phase lag to take place between the sound output from the speaker 15 and the sound input to the detection microphone 13, thus making it possible to improve the noise cancelling function.

<Present Technology>

The present technology can have the following configurations.

(1) An acoustic output apparatus including:

a detection microphone for detecting noise having an input vibrating plate;

a speaker having an output vibrating plate; and a housing accommodating at least the speaker and the detection microphone therein, in which the input vibrating plate and the output vibrating plate are disposed approximately in a same orientation.

(2) The acoustic output apparatus of feature (1), in which at least part of the detection microphone is located to be opposed to the speaker.

(3) The acoustic output apparatus of feature (2), in which the detection microphone as a whole is located to be opposed to the speaker.

(4) The acoustic output apparatus of any one of features (1) to (3), in which a distance between the detection microphone and the speaker is equal to or less than a radius of the detection microphone.

(5) The acoustic output apparatus of any one of features (1) to (4), in which a sound output device is provided to output a sound that differs in frequency band from a sound output from the speaker.

(6) The acoustic output apparatus of any one of features (1) to (5), in which an opening is formed in the housing, and a sensing microphone is provided to detect noise input from the opening.

(7) The acoustic output apparatus of feature (6), in which the sensing microphone is provided inside the housing, and the detection microphone is located on an opposite side of the sensing microphone with the speaker provided therebetween.

(8) The acoustic output apparatus of any one of features (1) to (7), in which a bracket is provided that has a sound conduit through which the sound output from the speaker passes, and the speaker and the detection microphone are attached to the bracket.

(9) The acoustic output apparatus of feature (8), in which a sound output device is provided to output a sound that differs in frequency band from the sound output from the speaker, and the sound output device is attached to the bracket.

(10) The acoustic output apparatus of feature (9), in which the sound output from the sound output device passes through the sound conduit.

(11) A sound output apparatus including:

a detection microphone for detecting noise having an input vibrating plate;

a speaker having an output vibrating plate; and a housing accommodating at least the speaker and the detection microphone therein, in which the speaker has its axis extending approximately in a same direction as an axis of the detection microphone.

REFERENCE SIGNS LIST

1 Acoustic output apparatus, 2 Housing, 5*f* Opening, 6 Bracket, 9 Sound conduit, 13 Detection microphone, 13*a* Input vibrating plate, 15 Speaker, 15*a* Output vibrating plate, 18 Sound output device, 20*a* Sensing microphone

The invention claimed is:

1. An acoustic output apparatus, comprising:

a detection microphone configured to detect first noise, wherein the detection microphone includes an input vibrating plate;

a speaker configured to output a first sound, wherein the speaker includes an output vibrating plate;

a register configured to adjust the first sound output from the speaker; and a housing that includes the speaker and the detection microphone; and a bracket that includes:

a sound conduit configured to pass the first sound output from the speaker; and a base surface section, wherein the detection microphone is attached to an upper portion of a front surface of the base surface section, the sound conduit protrudes from a lower portion of the front surface of the base surface section, the speaker is attached to a rear surface of the base surface section, a center hole of the register is attached to an adjustment hole on the rear surface of the base surface section, wherein a diameter of the center hole is smaller than a diameter of the adjustment hole, and the input vibrating plate and the output vibrating plate are substantially in a same orientation.

2. The acoustic output apparatus of claim 1, wherein a position of a part of the detection microphone is opposite to a position of the speaker.

3. The acoustic output apparatus of claim 1, wherein a position of an entirety of the detection microphone is opposite to a position of the speaker.

4. The acoustic output apparatus of claim 1, wherein a distance between the detection microphone and the speaker is one of equal to or less than a radius of the detection microphone.

5. The acoustic output apparatus of claim 1, further comprising a sound output device configured to output a second sound, wherein the second sound has a frequency band different from that of the first sound.

6. The acoustic output apparatus of claim 1, further comprising a sensing microphone, wherein the housing further includes an opening, and the sensing microphone is configured to detect second noise input from the opening.

7. The acoustic output apparatus of claim 6, wherein the housing further includes the sensing microphone, and the speaker is between the detection microphone and the sensing microphone.

8. The acoustic output apparatus of claim 1, further comprising a sound output device configured to output a second sound, wherein the second sound has a frequency band different from that of the first sound, and the sound output device is attached to the bracket.

9. The acoustic output apparatus of claim 8, wherein the sound conduit is further configured to pass the second sound output from the sound output device.

10. A sound output apparatus, comprising:

a detection microphone configured to detect noise, wherein the detection microphone includes an input vibrating plate;

a speaker configured to output sound, wherein the speaker includes an output vibrating plate; and a register configured to adjust the first sound output from the speaker;

a housing that includes the speaker and the detection microphone; and a bracket that includes:

a sound conduit configured to pass the sound output from the speaker; and a base surface section, wherein the detection microphone is attached to an upper portion of a front surface of the base surface section, the sound conduit protrudes from a lower portion of the front surface of the base surface section, the speaker is attached to a rear surface of the base surface section, a center hole of the register is attached to an adjustment hole on the rear surface of the base surface section, wherein a diameter of the center hole is smaller than a diameter of the adjustment hole, and an axis of the speaker extends substantially in a same direction as an axis of the detection microphone.

11. The acoustic output apparatus of claim 1, wherein the bracket further includes a tube surface section; and the tube surface section protrudes from a peripheral portion of the base surface section.

* * * * *